US012066268B2

(12) United States Patent
Benedict

(10) Patent No.: US 12,066,268 B2
(45) **Date of Patent: *Aug. 20, 2024**

(54) ACTIONLESS RIFLE

(71) Applicant: OutlierIP, LLC, Rockwall, TX (US)

(72) Inventor: Michael Derek Benedict, Rockwall, TX (US)

(73) Assignee: OutlierIP, LLC, Rockwall, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/868,594

(22) Filed: Jul. 19, 2022

(65) Prior Publication Data

US 2023/0128221 A1 Apr. 27, 2023

Related U.S. Application Data

(60) Provisional application No. 63/223,533, filed on Jul. 19, 2021.

(51) Int. Cl.

| | |
|---|---|
| ***F41A 3/26*** | (2006.01) |
| ***F41A 9/71*** | (2006.01) |
| ***F41A 21/30*** | (2006.01) |
| ***F41A 21/36*** | (2006.01) |
| ***F41A 21/48*** | (2006.01) |
| ***F41G 1/38*** | (2006.01) |
| *F41G 3/08* | (2006.01) |

(52) U.S. Cl.

CPC ..... *F41A 9/71* (2013.01); *F41A 3/26* (2013.01); *F41A 21/30* (2013.01); *F41A 21/36* (2013.01); *F41A 21/48* (2013.01); *F41G 1/38* (2013.01); *F41G 3/08* (2013.01)

(58) Field of Classification Search

CPC ..... F41A 3/12; F41A 3/18; F41A 3/26; F41A 3/64; F41A 3/66

See application file for complete search history.

(56) References Cited

U.S. PATENT DOCUMENTS

| | | | | |
|---|---|---|---|---|
| 2019/0154382 | A1* | 5/2019 | Pizano | F41A 3/72 |
| 2019/0271515 | A1* | 9/2019 | Gibbens | F41A 15/14 |
| 2023/0019581 | A1* | 1/2023 | Benedict | F41A 3/66 |

* cited by examiner

*Primary Examiner* — J. Woodrow Eldred

(74) *Attorney, Agent, or Firm* — Donald B Buchanan

(57) ABSTRACT

A rifle includes a magazine well, a barrel, and an exo-bolt. The barrel is configured to be detachably coupled to the magazine well. The barrel includes a forward barrel portion on an end of the barrel opposite the magazine well. The exo-bolt is configured to travel along an exterior of the barrel.

7 Claims, 17 Drawing Sheets

200

300

400

ACTIONLESS RIFLE

CROSS REFERENCE TO RELATED APPLICATIONS

The present application claims priority from a previously provisional application, Ser. No. 63/223,533, filed Jul. 19, 2021, entitled "Actionless Rifle," by the same inventor, which is incorporated herein in its entirey.

FIELD OF THE INVENTION

The present invention relates to firearms.

BACKGROUND

Firearms serve both recreational and functional purposes in the private sector as well as in the military. Shooting is performed at a competitive level with many tours and events being held every year. Long range and precision shooting also offers tactical advantages in a military setting. For many reasons, excellence is a premium in the field.

Excellence in long range and precision shooting is dependent on skills that require extensive training and practice. However, elements of the weapon system can also contribute to firing effectiveness on both primary and secondary levels. Rifles can be long, heavy, and provide physical recoil as well as gaseous discharge. Minimizing weight, recoil, gaseous discharge, and versatility can provide the shooter a highly desirable advantage.

SUMMARY

One embodiment of an actionless rifle may include a magazine well, a barrel, and an exo-bolt. The barrel may be configured to be detachably coupled to the magazine well. The barrel may include a forward barrel portion on an end of the barrel opposite the magazine well. The exo-bolt may be configured to travel along an exterior of the barrel.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
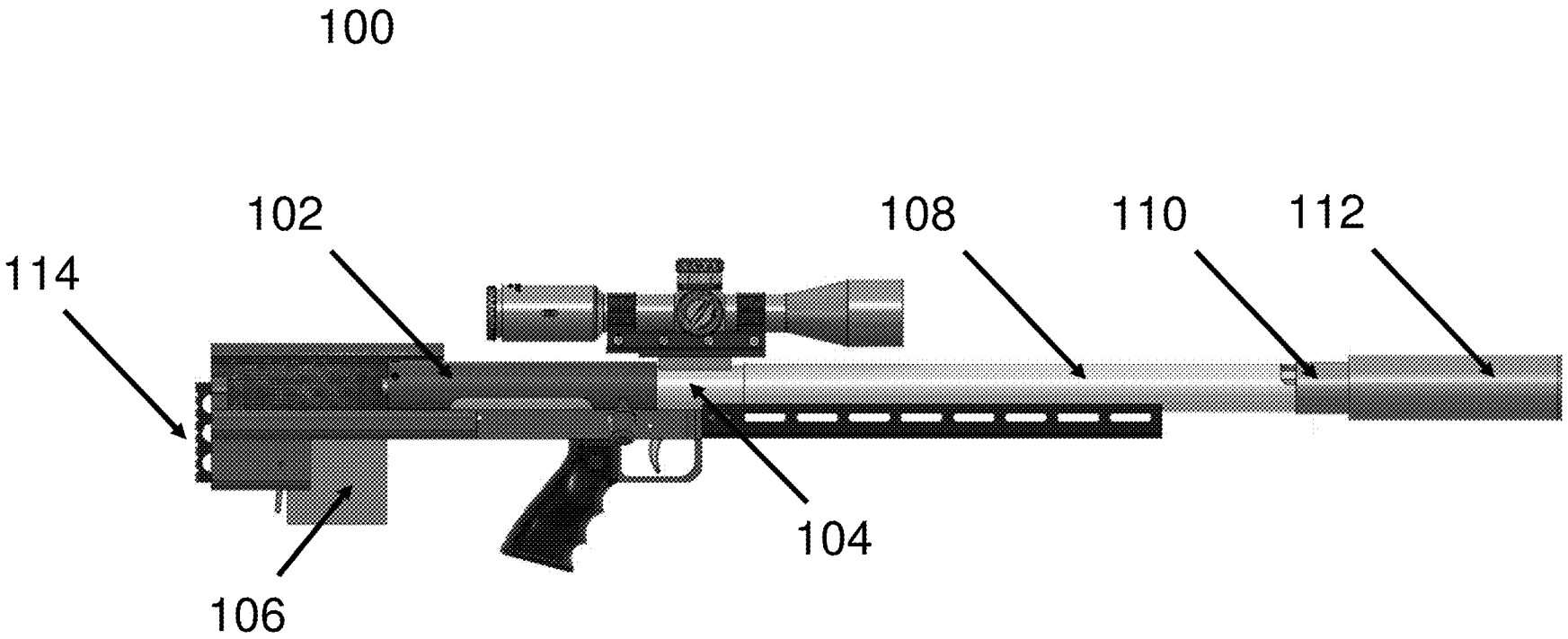
FIG. 1 is a perspective image of a side of an actionless rifle.

The foregoing is directed to an actionless rifle according to embodiments of the invention. Referring now to FIG. 1, an image of a side of an actionless rifle 100 is described. The actionless rifle 100 may comprise an exo-bolt 102 configured to travel along a barrel 104. The actionless rifle 100 may further comprise an adjustable magwell 106. In some embodiments, the actionless rifle 100 may further comprise a sleeve 108 around a portion of the barrel 104. The actionless rifle 100 may further comprise a muzzle brake 110, a suppressor 112, and a collapsible stock 114.

The exo-bolt 102 may be configured to travel along an exterior of the barrel 104. The exo-bolt 102 may be further configured to stabilize itself on the exterior of the barrel 104. The exo-bolt 102 may be fully extended toward the collapsible stock 114 in order to grab a round and then pushed fully forward toward the barrel 104 in order to chamber the round. The barrel 104 may comprise a raceway, as further described hereinbelow with regards to FIG. 8. The exo-bolt 102 may travel along the barrel 104 as guided by the raceway.

One of ordinary skill in the art will recognize that an action is not necessary in the current configuration. As a result, one of ordinary skill in the art will recognize that a reduction in weight is achieved due to the absence of an action. Additionally, one of ordinary skill in the art will appreciate that an action will not need to be machined during the manufacturing of the rifle.

Figure 2:
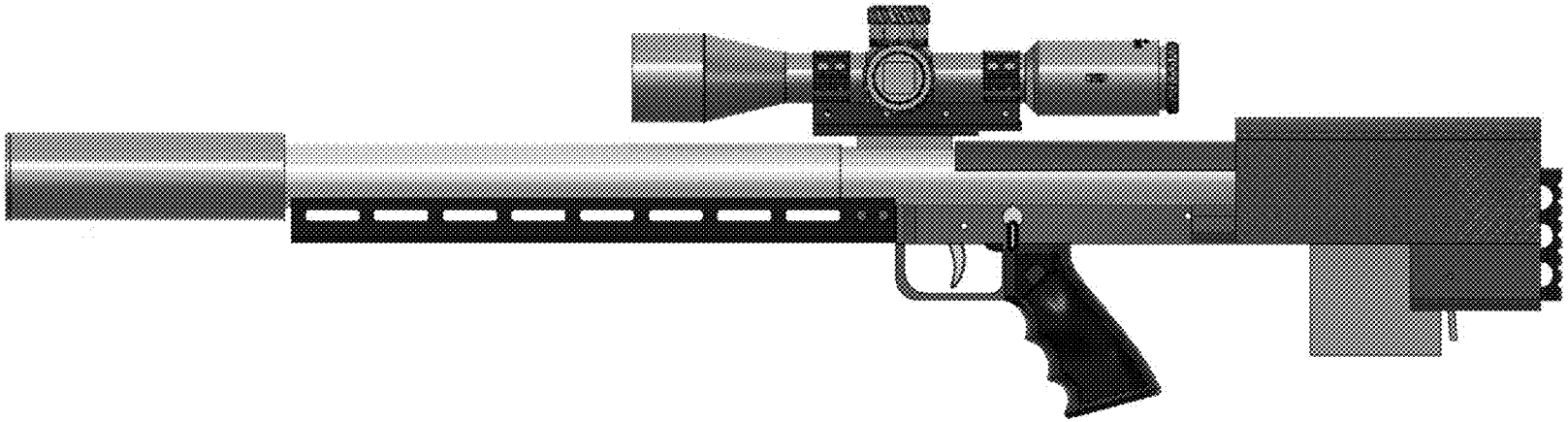
FIG. 2 is a perspective image of a second side of an actionless rifle.

Referring now to FIG. 2, an image of a second side of an actionless rifle 200 is described. The actionless rifle 200 may be the actionless rifle 100 according to FIG. 1.

Figure 3:
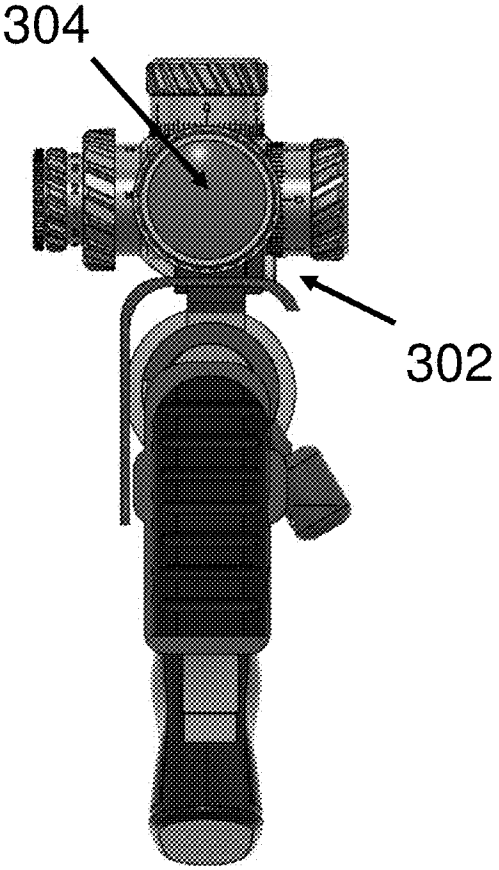
FIG. 3 is a perspective image of a rear side of an actionless rifle.

Referring now to FIG. 3, an image of a rear side of an actionless rifle 300 is described. The actionless rifle 300 may be the actionless rifle 100 according to FIG. 1. The actionless rifle 300 may comprise a scope 302. The scope 302 may comprise an ocular lens 304 and an objective lens opposite the scope 302 from the ocular lens 304. The scope 302 may further comprise a reticle internal to the scope, such as reticle 1700 described further hereinbelow with regards to FIG. 17, configured to assist a user with aiming the actionless rifle 300.

Figure 4:
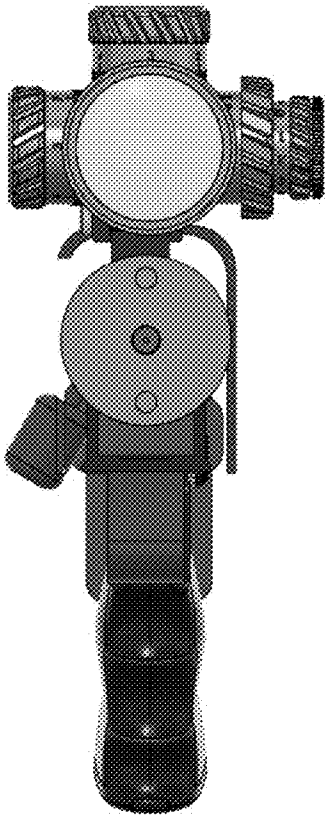
FIG. 4 is a perspective image of a front side of an actionless rifle.

Referring now to FIG. 4, an image of a front side of an actionless rifle 400 is described. The actionless rifle 400 may be the actionless rifle 100 according to FIG. 1.

Figure 5:
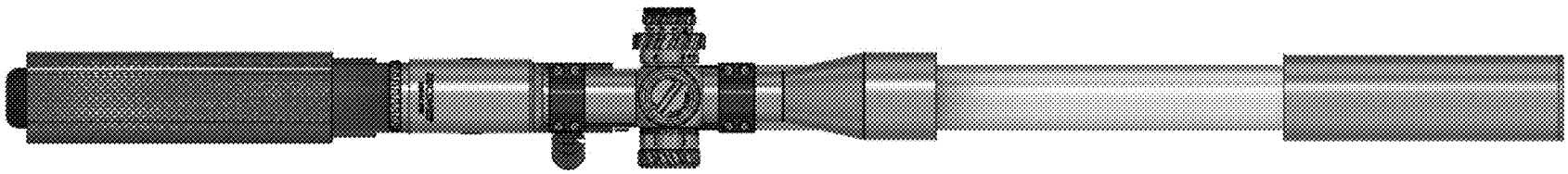
FIG. 5 is a perspective image of a top side of an actionless rifle.

Referring now to FIG. 5, an image of a top side of an actionless rifle 500 is described. The actionless rifle 500 may be the actionless rifle 100 according to FIG. 1.

Figure 6:
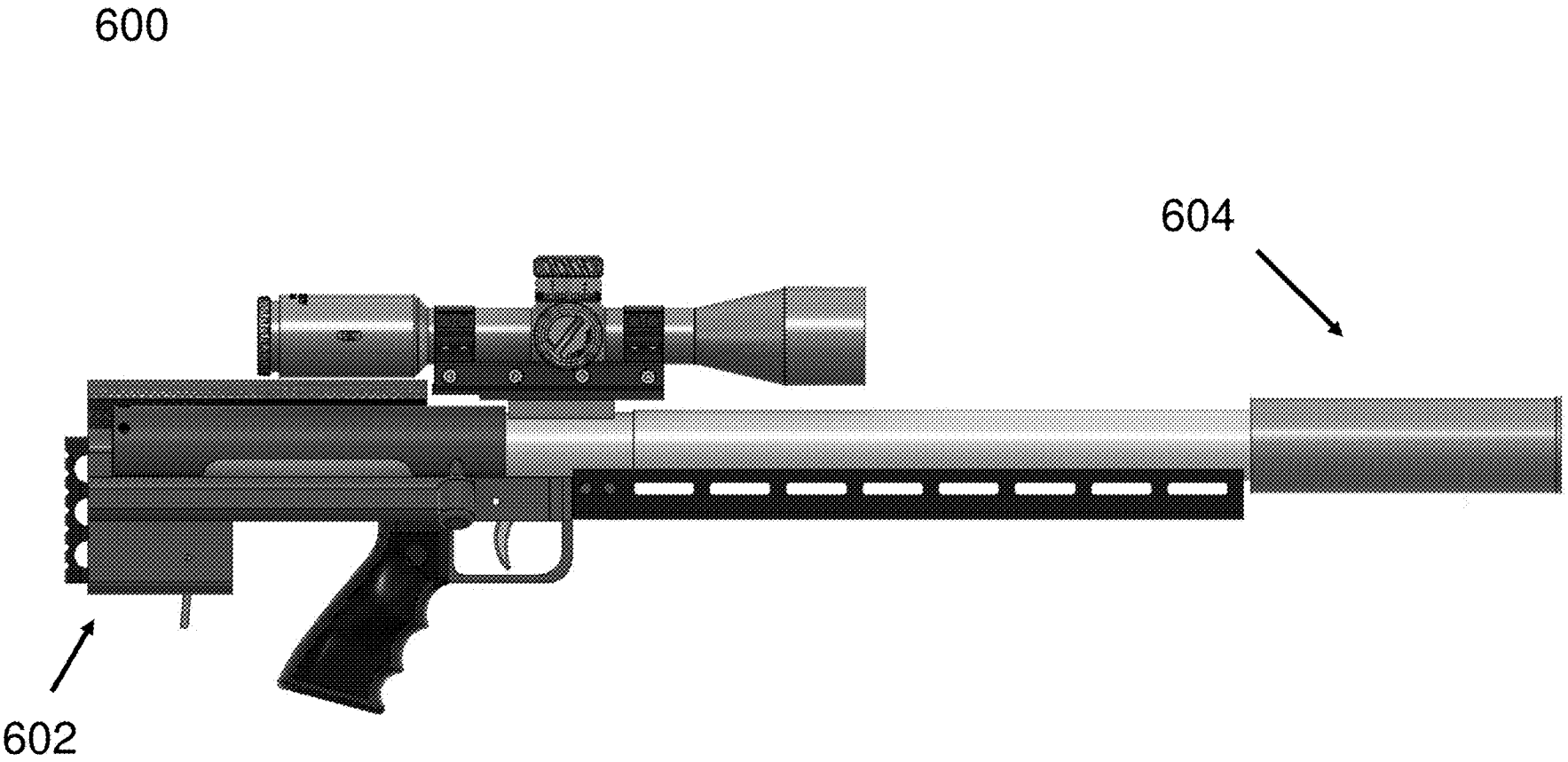
FIG. 6 is a perspective image of a side of an actionless rifle in a collapsed state.

Referring now to FIG. 6, an image of a side of an actionless rifle 600 in a collapsed state is described. The actionless rifle 600 may be the actionless rifle 100 according to FIG. 1. The actionless rifle 600 in collapsed state may comprise a stock 602 fully pushed forward toward a barrel of the actionless rifle 600 and a suppressor 604 fully pushed back toward the barrel of the actionless rifle 600. The collapsible stock 602 and suppressor 604 may be the collapsible stock 114 and suppressor 112 according to FIG. 1.

In one embodiment, an exo-bolt of the actionless rifle 600 is pushed forward along the barrel prior to pushing forward the collapsible stock 602. The suppressor 604 may be a retractable suppressor and discussed further hereinbelow with regards to FIG. 16. One of ordinary skill in the art will recognize that the collapsed state of the actionless rifle 600 is significantly shorter than that of a traditional rifle.

Figure 7:
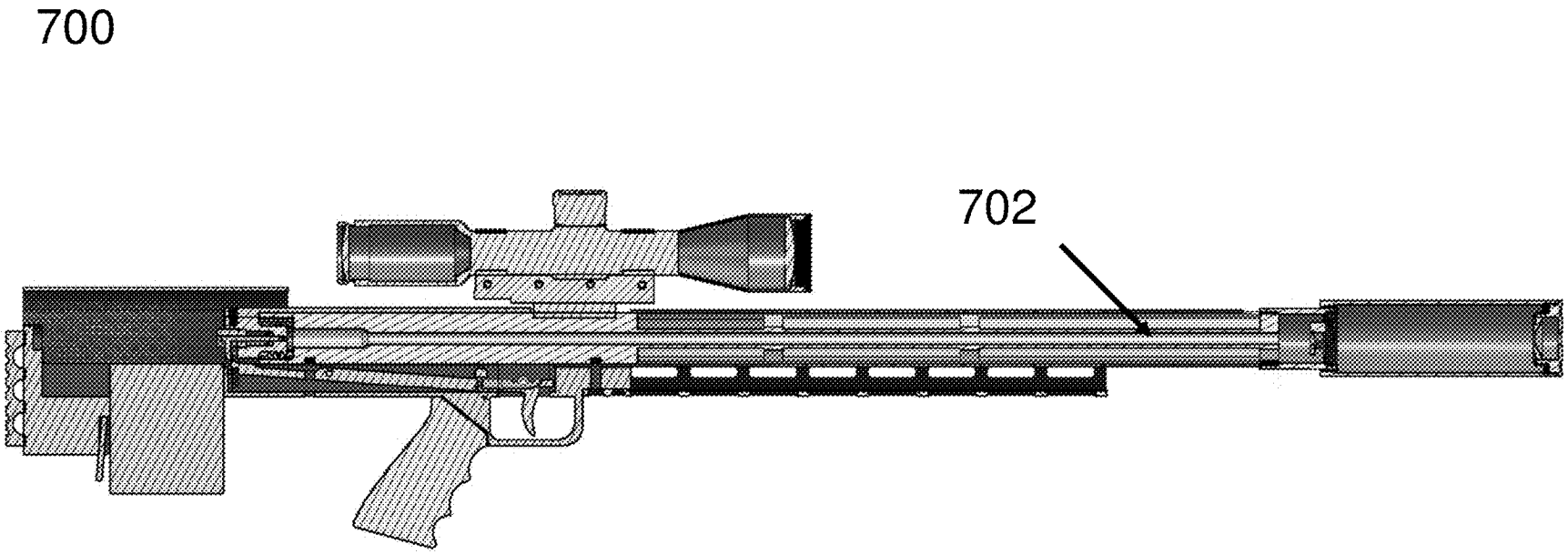
FIG. 7 is a cross-sectional perspective image of a side of an actionless rifle in a deployed mode.

Referring now to FIG. 7, a cross-sectional image of a side of an actionless rifle 700 in an extended state is described. The actionless rifle 700 may be the actionless rifle 100 according to FIG. 1. The actionless rifle 700 may comprise a bore 702 that runs down a central portion of a barrel of the actionless rifle 700. A round may be fired by being propelled down the bore 702 and out a front end of the barrel.

Figure 8:
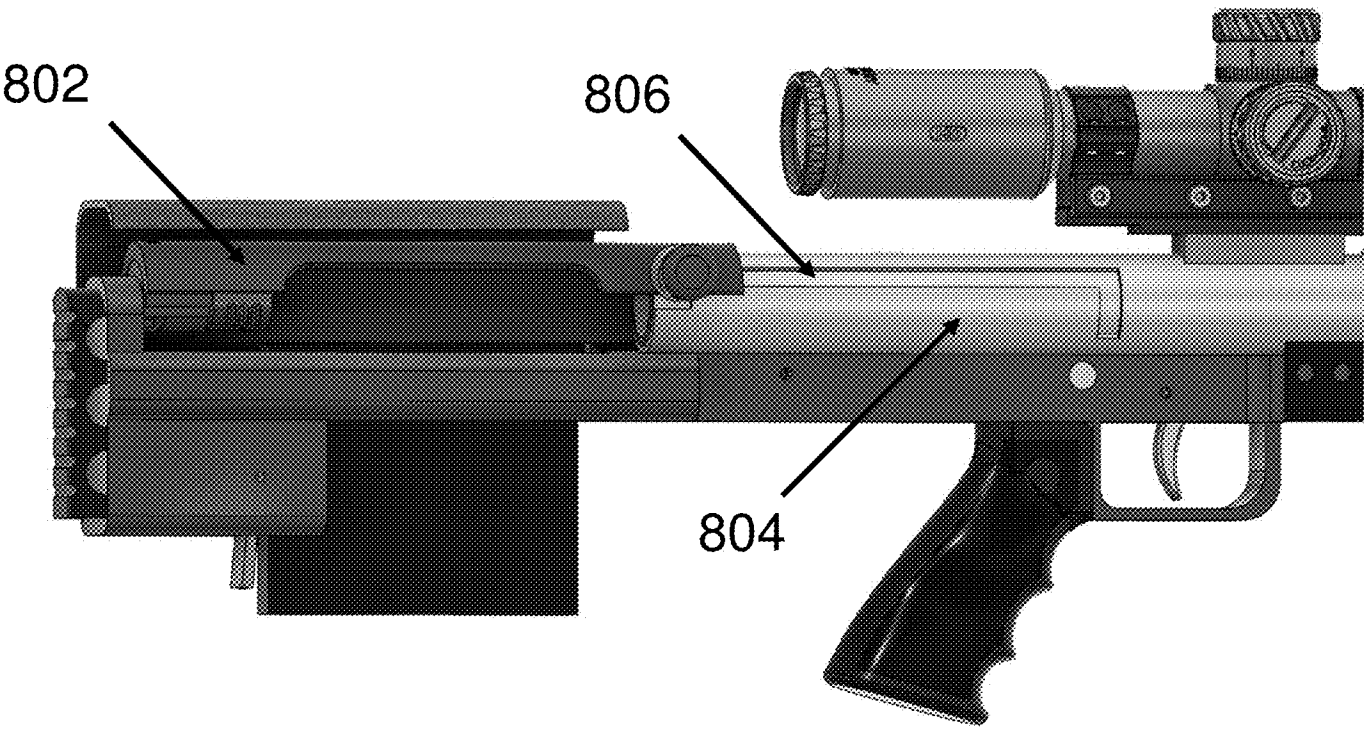
FIG. 8 is a perspective image of a side of an actionless rifle with an open bolt.

Referring now to FIG. 8, an image of a side of an actionless rifle 800 with an open bolt is described. The actionless rifle 800 may be the actionless rifle 100 according to FIG. 1. The actionless rifle 800 may comprise an exo-bolt 802 and a barrel 804. The barrel 804 may be configured to comprise a raceway 806 on an external portion of the barrel 804. The exo-bolt 802 may be configured to travel along the raceway 806. The exo-bolt 802 of FIG. 8 may depict an open bolt that may be ready to grab a round from a magazine in a magwell and chamber the round into the barrel 804. The exo-bolt 802 and barrel 804 may be the exo-bolt 102 and barrel 104 according to FIG. 1.

Figure 9:
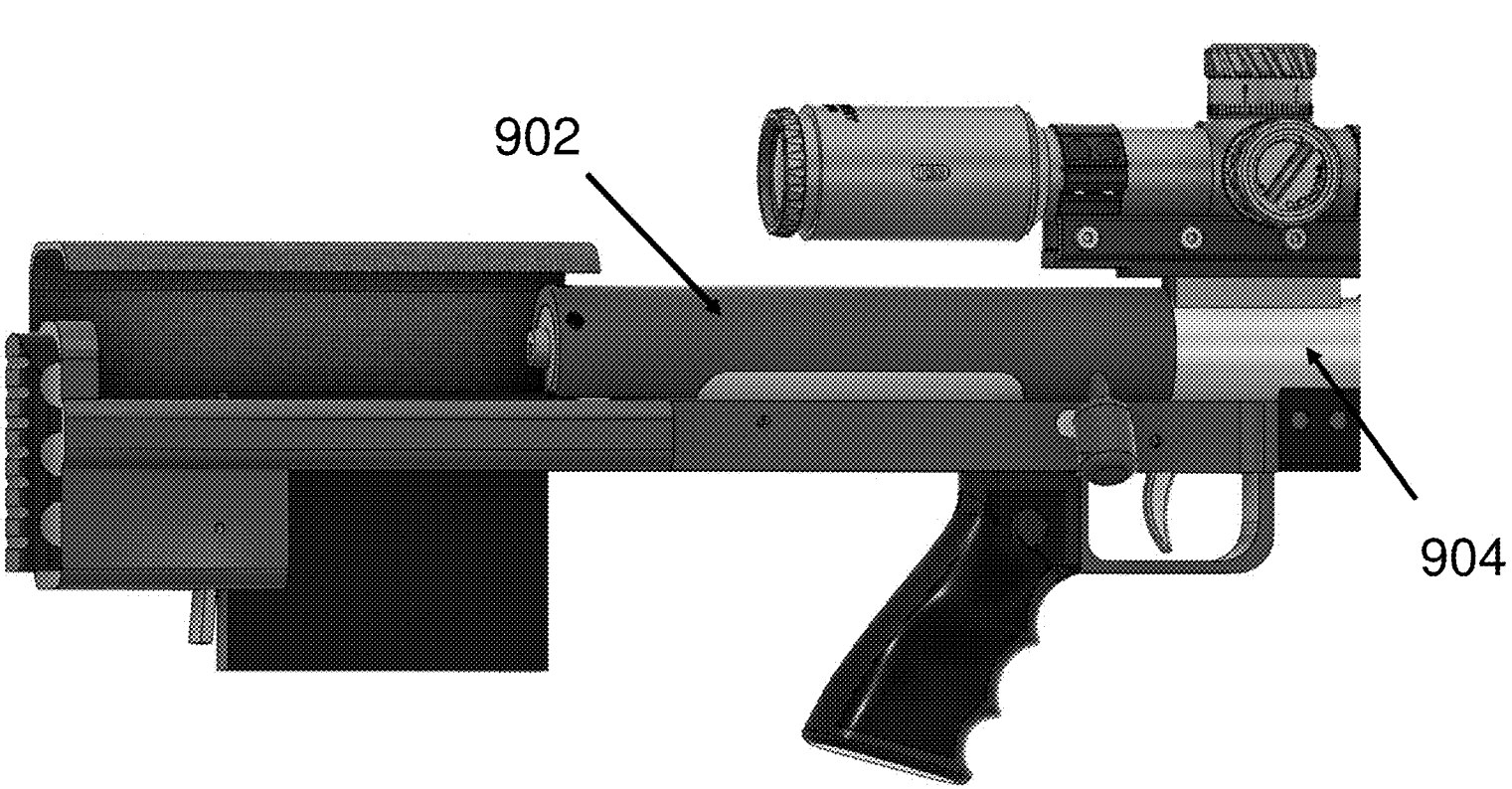
FIG. 9 is a perspective image of a side of an actionless rifle with a closed bolt.

Referring now to FIG. 9, an image of a side of an actionless rifle 900 with a closed bolt is described. The actionless rifle 900 may be the actionless rifle 100 according to FIG. 1. The actionless rifle 900 may comprise an exo-bolt 902 and a barrel 904. The exo-bolt 902 may be put into a closed bolt position by pushing the exo-bolt 902 forward along the barrel 904 by following a raceway. At the end of the raceway, the exo-bolt 902 may rotate clockwise to complete the closed bolt position.

Figure 10:
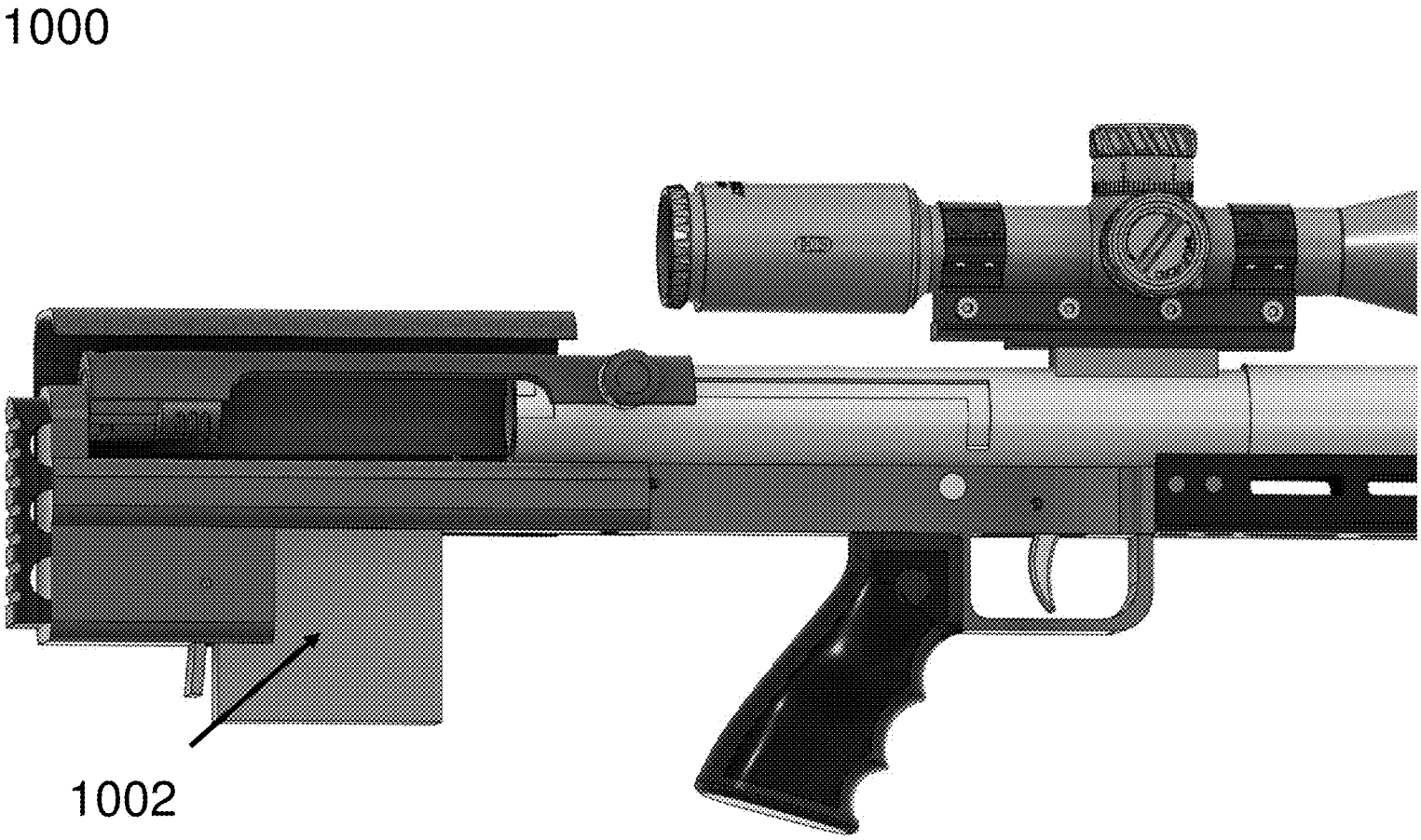
FIG. 10 is a perspective image of a side of an actionless rifle with an adjustable magazine well.

Referring now to FIG. 10, an image of a side of an actionless rifle 1000 with an adjustable magazine well 1002 is described. The actionless rifle 1000 may be the actionless rifle 100 according to FIG. 1. The actionless rifle 1000 may comprise an adjustable buttstock configured to come forward to adjust a length of the adjustable magazine well 1002. One of ordinary skill in the art will recognize that the adjustable magazine well 1002 may be configured to receive a plurality of different magazine sizes.

Figure 11:
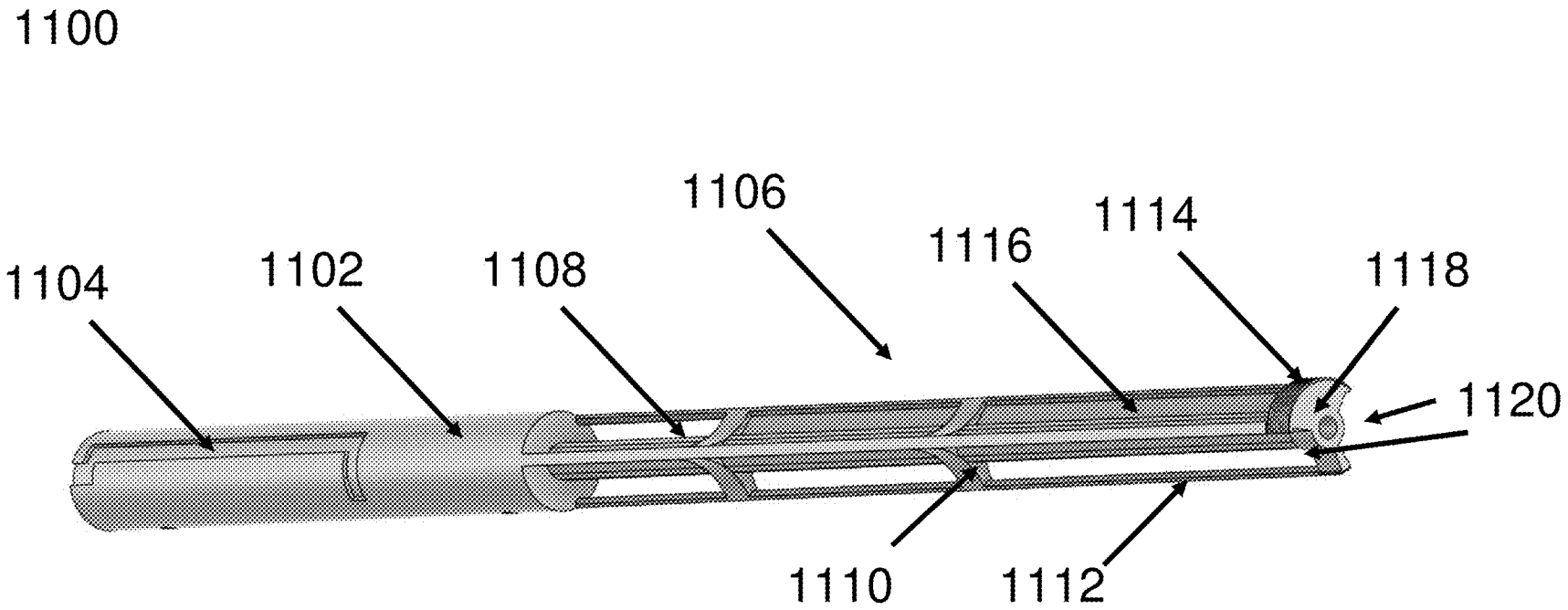
FIG. 11 is a perspective image of a barrel of an actionless rifle.

Referring now to FIG. 11, an image of a barrel 1100 of an actionless rifle is described. The barrel 1100 may be the barrel 104 according to FIG. 1. The barrel 1100 may comprise a main body 1102 of the barrel 1100 configured to receive and support an exo-bolt. The main body 1102 may be machined to have a raceway 1104 that may be configured to guide the exo-bolt between an open bolt position and a closed bolt position as described hereinabove. The barrel 1100 may further comprise a forward barrel portion 1106. The forward barrel portion 1106 may comprise a bore 1108, a plurality of perpendicular barrel support structures 1110, a plurality of parallel barrel support structures 1112, a muzzle thread 1114 for receiving a muzzle brake, a channel wall 1116, and a closed channel wall 1118.

In one embodiment, the perpendicular barrel support structures 1110 the channel wall 1116, and a sleeve as described hereinbelow with reference to FIG. 12, create three channels running a full length of the forward barrel portion 1106. Two of the three channels may be open channels 1120 with the third channel being a closed channel that ends at the closed channel wall 1118. In response to a round being fired, gas that is propelling the round forward may be discharged, in part and in response to a muzzle brake as described hereinbelow with regards to FIGS. 13-14, back down the two open channels 1120 to a segment of the forward barrel portion 1106 that is contiguous between the two open channels 1120 and the closed channel. The discharged gas may then route back forward along the closed channel and out of a gas discharge port as pictured hereinbelow with reference to FIG. 12. A remainder of the gas may discharge forward out of the bore and towards at least one of a muzzle brake, a suppressor, and open air. One of ordinary skill in the art will appreciate that a reduction in discharged gas at the exit of the round will reduce damage to hearing, reduce visibility of a shooter as a result of reduced muzzle flash, reduce discharged gas being toward the shooter as well as dust printing, and reduce recoil, among other benefits.

Figure 12:
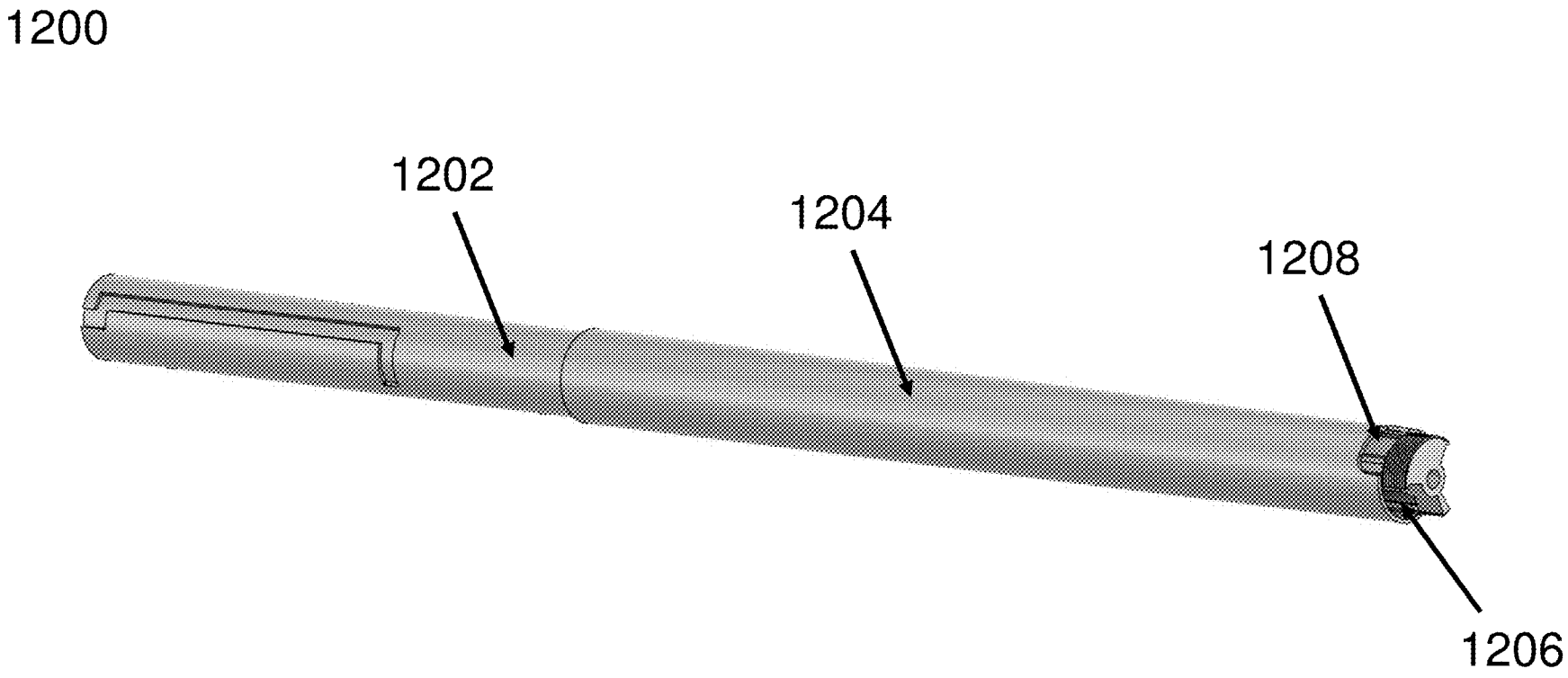
FIG. 12 is a perspective image of a barrel of an actionless rifle with a tube cover.

Referring now to FIG. 12, an image of a barrel 1200 of an actionless rifle with a sleeve 1204 is described. The barrel 1200 may be the barrel 104 according to FIG. 1. The barrel 1200 may comprise a main body 1202 and a forward barrel portion. The sleeve 1204 may be removably coupled to the forward barrel portion. In one embodiment, the sleeve 1204 may be temporarily coupled to the forward barrel portion. In another embodiment, the sleeve 1204 may be permanently coupled to the forward barrel portion. The forward barrel portion may be the forward barrel portion 1106 according to FIG. 11. The sleeve 1204 and forward barrel portion may create a plurality of channels. At least one of the plurality of channels may be configured to be an open channel 1206. At least one of the remainder of the plurality of channels may be configured to be a closed channel. The at least one open channel 1206 may be the open channels 1120 according to FIG. 11. The sleeve 1204 may be configured to have a cut out at a forward that covers the closed channel. In one embodiment, the cut out may be configured to be a gas discharge port 1208 as described hereinabove with regards to FIG. 11.

Figure 13:
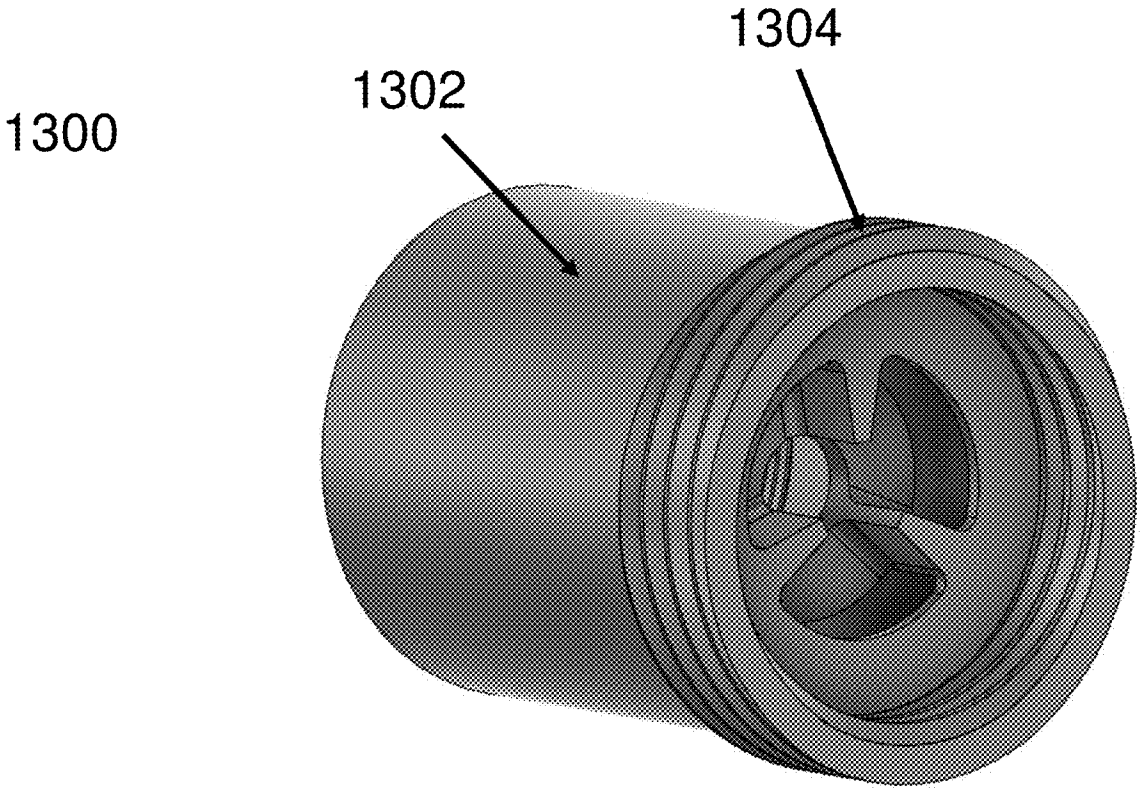
FIG. 13 is a perspective image of a muzzle brake.

Referring now to FIG. 13, an image of a muzzle brake 1300 is described. The muzzle brake 1300 may be the muzzle brake 110 according to FIG. 1. The muzzle brake 1300 may comprise a muzzle brake housing 1302 and suppressor threads 1304. The muzzle brake 1300 may function as an extension of a suppressor.

Figure 14:
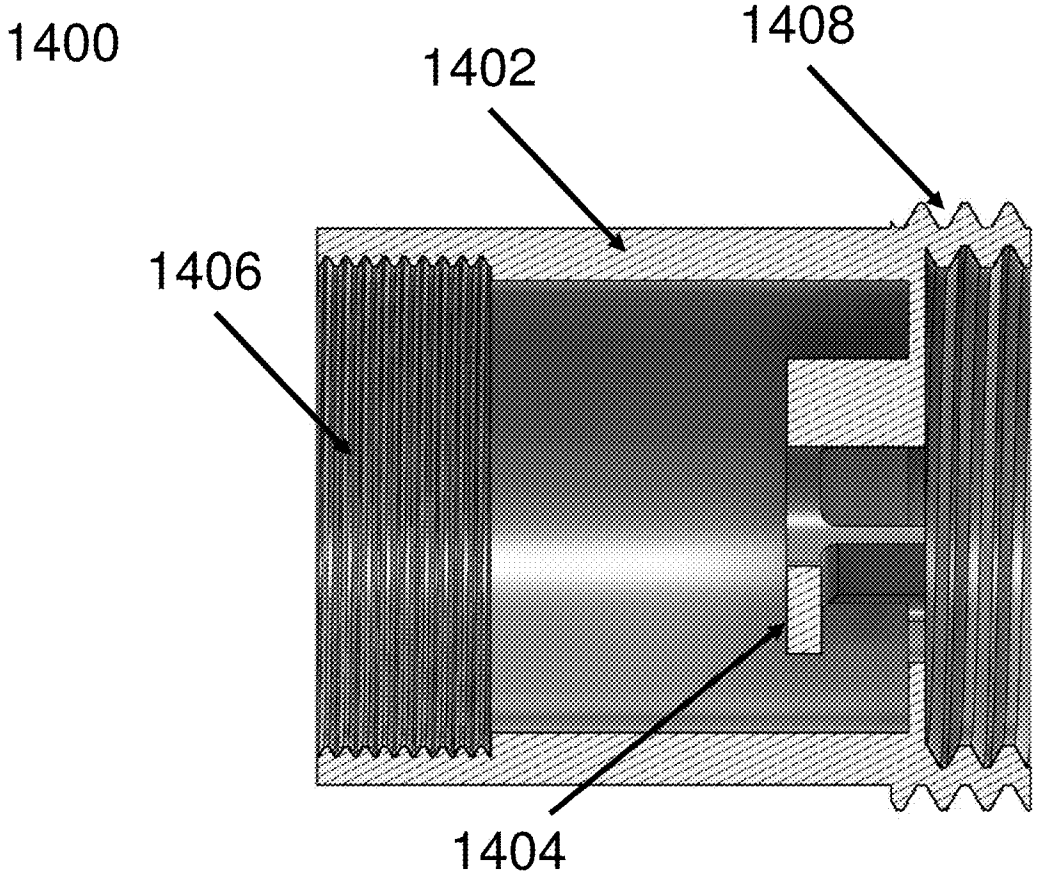
FIG. 14 is a cross-sectional perspective image of a side of a muzzle brake.

Referring now to FIG. 14, a cross-sectional image of a side of a muzzle brake 1400 is described. The muzzle brake 1400 may be the muzzle brake 1300 according to FIG. 13. The muzzle brake 1400 may comprise a muzzle brake housing 1402, an initial structure 1404, barrel threads 1406, and suppressor threads 1406. The initial structure 1404 may block a portion of gas and particulates propelling a round forward from being propelled out of the muzzle brake 1400. The blocked portion of gas may be discharged back toward open channels around a bore of a barrel. One of ordinary skill in the art will appreciate that the muzzle brake 1400 with initial structure 1404, particularly when connected to a suppressor, creates a blast chamber and effectively extends the suppressor by the length of the muzzle brake 1400. One of ordinary skill in the art will also recognize that the muzzle brake 1400 acting as an extension of the suppressor allows the suppressor to be shorter in length resulting in reduced profile and weight while seeing maintained, or increased, performance.

Figure 15:
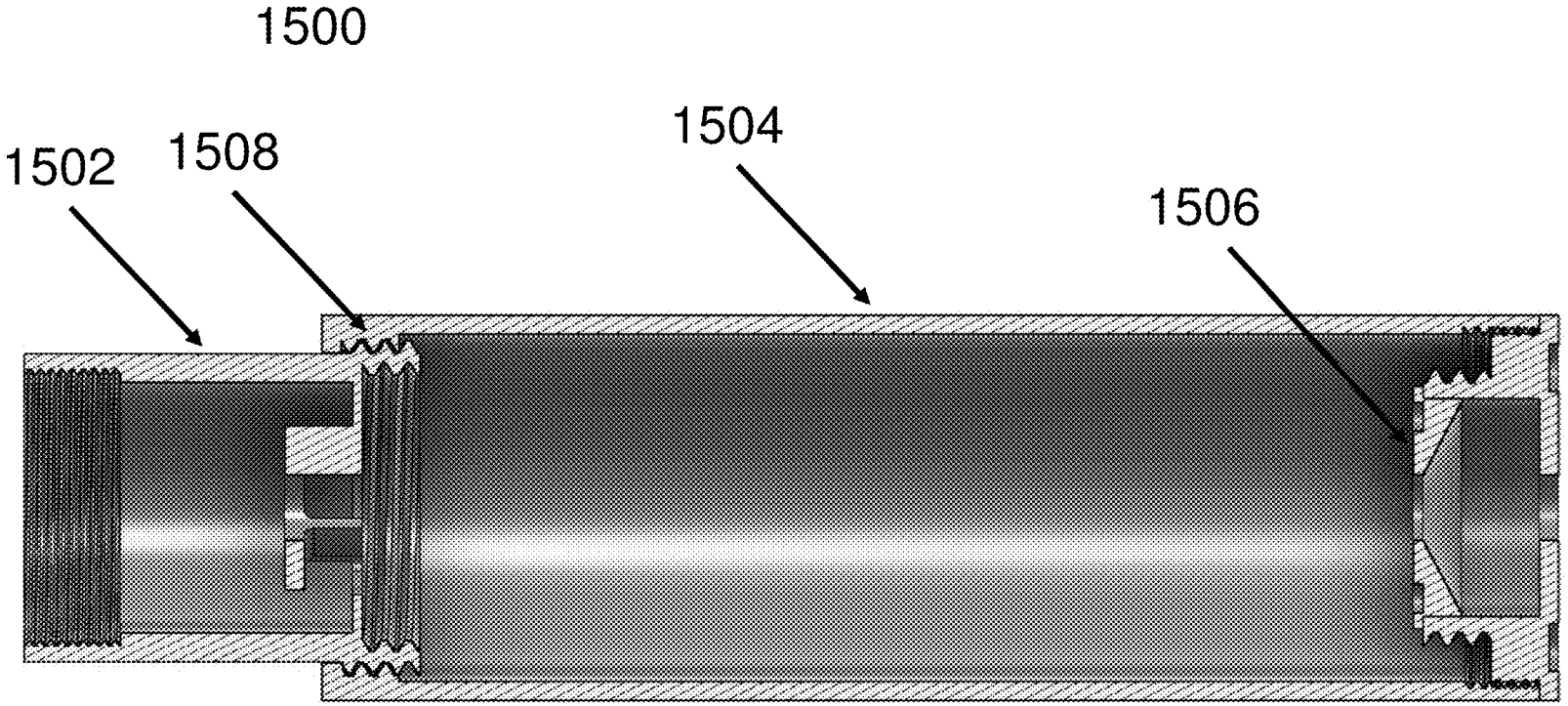
FIG. 15 is a cross-sectional perspective image of a retractable suppressor in a deployed state.

Referring now to FIG. 15, a cross-sectional image of a retractable suppressor 1500 in a deployed state is described. The retractable suppressor 1500 may be the suppressor 112 according to FIG. 1. The retractable suppressor 1500 may be removably coupled to a muzzle brake 1502. The retractable suppressor 1500 may comprise a main suppressor body 1504 and an end cap 1506 internal to the main suppressor body 1504. An end of the main suppressor body 1504 opposite an end of the main suppressor body 1504 housing the end cap 1506 may comprise deployed state threads 1508 that may be configured to be removably coupled to threads of the muzzle brake 1502.

Figure 16:
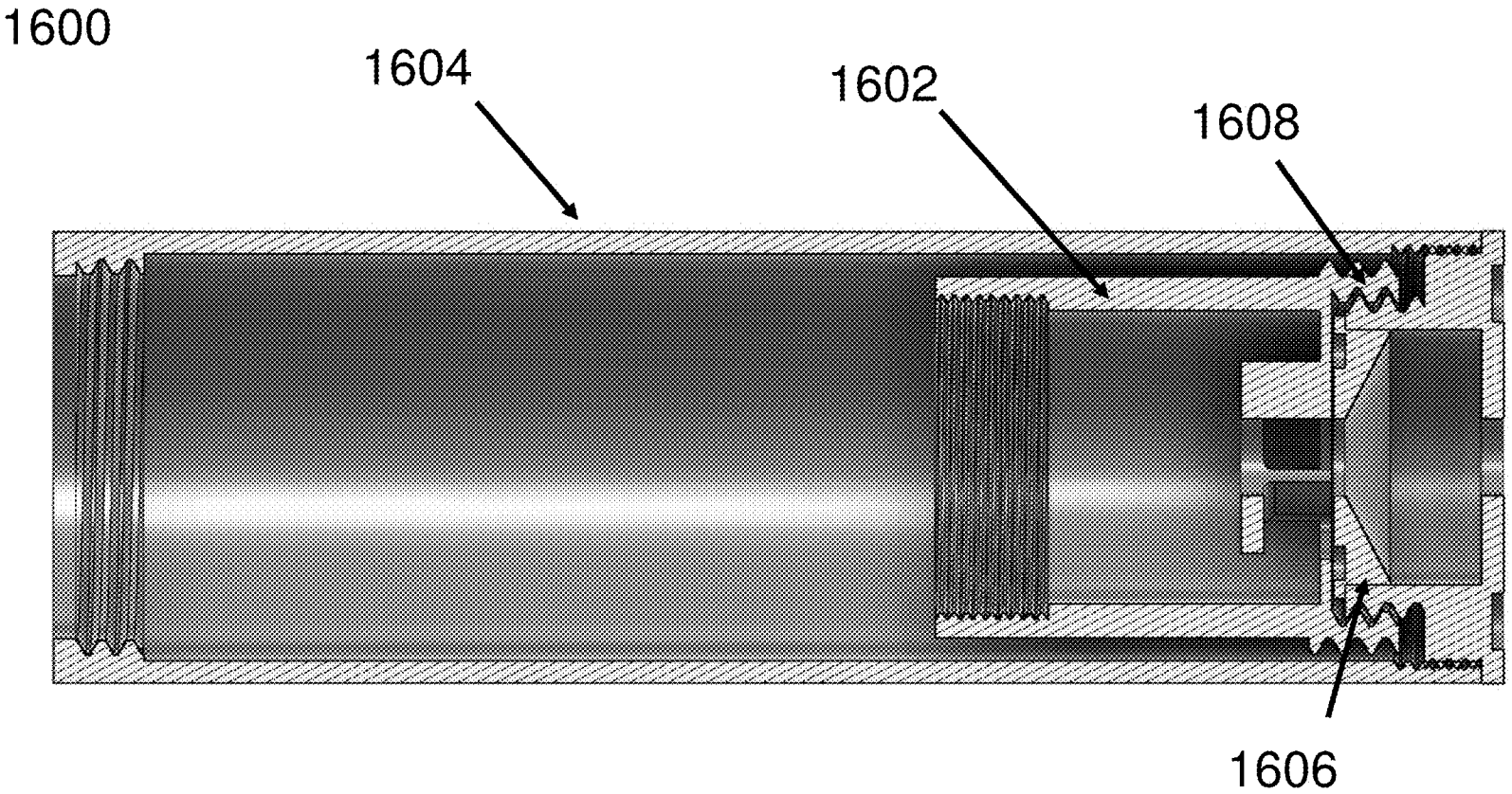
FIG. 16 is a cross-sectional perspective image of a retractable suppressor in a collapsed state.

Referring now to FIG. 16, a cross-sectional image of a retractable suppressor 1600 in a collapsed state is described. The retractable suppressor 1600 may be the retractable suppressor 1500 according to FIG. 15. The retractable suppressor 1600 may be configured to be removably coupled to a muzzle brake 1602. The retractable suppressor 1600 may comprise a main suppressor body 1604. The main suppressor body 1604 may comprise an end cap 1606. The end cap 1606 may comprise collapsed state threads 1608 that may be configured to be removably coupled to threads of the muzzle brake 1602.

Figure 17:
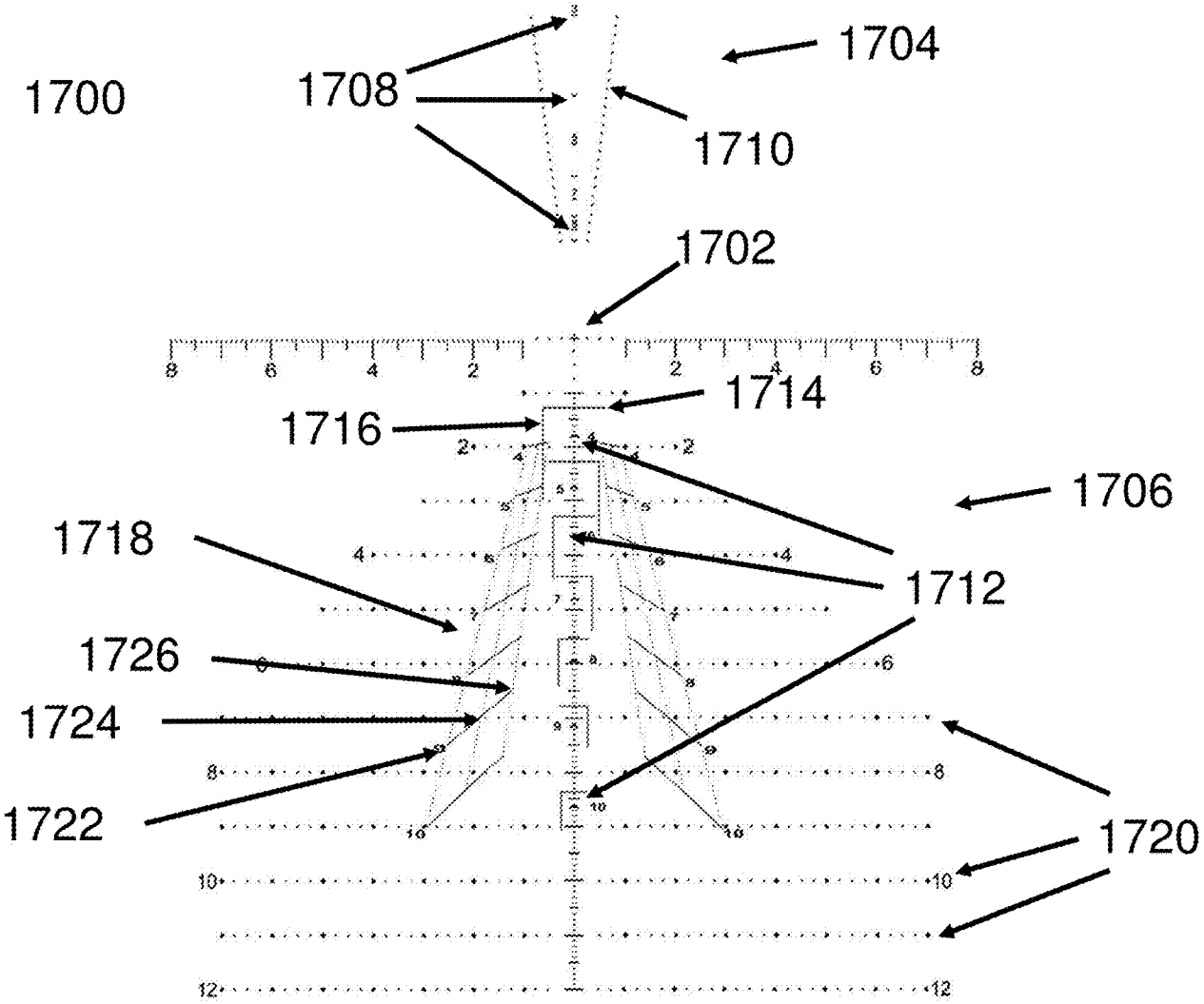
FIG. 17 is a diagram of a reticle.

Referring now to FIG. 17, a diagram of a reticle 1700 is described. The reticle 1700 may comprise a crosshair 1702, a ranging section 1704, and a targeting section 1706. The ranging section 1704 may comprise a plurality of target height chevrons 1708 and a target shoulder width guide 1710. The targeting section 1704 may comprise a plurality of center mass ballistic solution chevrons 1712, a plurality of known length (KL) box shoulder bars 1714, a plurality of KL box upper torso bar 1716, a density altitude guide 1718, and a wind compensation guide 1720. The density altitude guide may comprise a plurality of lines that correspond with distances from target. Each of the lines may comprise a bottom of the line 1722, a middle of the line 1724, and a top of the line 1726.

The target height chevron 1708 is configured to estimate a distance of a target with the target's feet approximately at the crosshair 1702. In one embodiment, the target height chevrons 1708 represent hundreds of yards of distance away from the target. For example, a target with feet at the crosshair 1702 and with a top of the target head approximately at target height chevron 1708 number 3 is approximately 300 yards away. The target shoulder width guide 1710 is configured to correspond with a distance from target that approximately corresponds with the target height chevron 1708 just above the target's head when the target's shoulders are approximately lined up flush with a left and right side of the target shoulder width guide 1710.

In one embodiment, the ranging section 1704 is configured to correspond with a North Atlantic Treaty Organization (NATO) target size. One of ordinary skill in the art will appreciate that the ranging section 1704 can be configured to correspond with any target size established by a user.

One of ordinary skill in the art will also appreciate that the ranging section 1710 is configured to obtain multiple measurements simultaneously, such as distance based on approximate height of a target and distance based on approximate shoulder width of a target. One of ordinary skill in the art will recognize that a target can be ranged according to shoulder width if the target is sitting down, for example. Additionally, the target can be ranged according to height if the target is facing a side and not presenting a full shoulder width to the shooter.

The targeting section 1706 may be configured to utilize a known length box, density altitude (KL Box Delta) guide. The plurality of center mass ballistic solution chevrons 1712 may represent a location of an approximate shot, also referred to as a center mass shot, on a target at various distances, such as, but not limited to, a hundred yards for every number represented next to the center mass ballistic solution chevrons 1712 when the target fills a KL box corresponding to the center mass ballistic solution chevron 1712. One of ordinary skill in the art will recognize that the center mass ballistic solution chevrons 1712 may represent a ballistic drop compensation, also referred to as a bullet drop compensation.

The KL box shoulder bar 1714 and KL box upper torso bar 1716 may combine to form the KL box. The various KL boxes in the targeting section 1706 may be configured to be KL boxes that correspond to a target at various distances, such as, but not limited to hundred yards for every number represented next to the center mass ballistic solution chevron 1712 that is in a center of the KL box.

The KL box shoulder bar 1714 is configured to correspond to a target's shoulder width at a distance determined by the center mass ballistic solution chevron 1712 just below the KL box shoulder bar 1714. The KL box upper torso bar 1716 is configured to correspond to a target's waist to shoulder height at a distance determined by the center mass ballistic solution chevron 1712 just inside the KL box upper torso bar 1716. For example, a target with a shoulder width and waist to shoulder height that fill the KL box created by KL box shoulder bar 1714 and KL box upper torso bar 1716 would be approximately 400 yards away. One of ordinary skill in the art will appreciate that chevrons of the ranging section 1704 and the targeting section 1706 can be configured to represent any increment of distances determined by the user. One of ordinary skill in the art will also appreciate that the targeting section 1704 allows a user to simultaneously target using height and width with a ballistic drop compensation represented on the reticle 1700.

In one embodiment, a user may range a target using the ranging section 1704 and then target in the corresponding region of the target section 1706 based on the distance approximated in the ranging section 1704. In another embodiment, the user may range a target by estimating distance using the KL boxes of the target section 1706. In yet another embodiment, the user may use a separate piece of equipment, such as, but not limited to, a laser range finder to capture distance to target, and then use the appropriate region of the target section 1706 corresponding to that distance.

The density altitude guide 1718 is configured to compensate for ballistic travel affected by air density at various altitudes. The plurality of lines in the density altitude guide 1718 correspond to density altitude compensations over various distances from the target, such as, but not limited to, a hundred yards for every number represented next to the line. The bottom of the line 1722 may correspond to sea level. The middle of the line 1724 may correspond to an altitude of 5,000 feet. The top of the line may correspond to an altitude of 10,000 feet. Dotted lines running vertically through the density altitude guide 1718 may correspond to a compensation of wind, for example, a compensation of 10 miles per hour at that altitude and distance from target. One of ordinary skill in the art will appreciate that the lines may be configured to cover any range of altitudes determined by the user.

One of ordinary skill in the art will appreciate that the density altitude guide may also be represented as a firing solution card, also referred to as a data card, even if a rifle does not comprise the density altitude guide in its optic. One of ordinary skill in the art will also appreciate that the density altitude guide may be extended for further distances and may also comprise additional data points such as, but not limited to, the ballistic curve, also referred to as a drag curve, of a particular bullet. One of ordinary skill in the art will recognize that the reticle 1700 may be represented in any form of angular measurement such as, but not limited to, minute of angle reticles and mil-radian reticles.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced items.

What is claimed:

1. A rifle, comprising:

a magazine well;

a barrel detachably coupled to the magazine well, the barrel comprising a forward barrel portion on an end of the barrel opposite the magazine well; and an exo-bolt configured to travel along an exterior of the barrel.

2. The rifle according to claim 1, wherein the barrel comprises a raceway along the exterior of the barrel and wherein the exo-bolt travelling along the exterior of the barrel comprises the exo-bolt being guided by the raceway.

3. The rifle according to claim 2, wherein the raceway is configured to guide the exo-bolt to a fully extended position that comprises the exo-bolt fully extended toward the magazine well causing the exo-bolt to grab a round from a magazine in the magazine well.

4. The rifle according to claim 3, wherein the raceway is further configured to guide the exo-bolt to chamber the grabbed round in response to the exo-bolt being pushed toward the forward barrel portion of the barrel.

5. The rifle according to claim 4, wherein the raceway is further configured to rotate the exo-bolt clockwise at an end of the raceway opposite the magazine well.

6. The rifle according to claim 2, wherein the raceway is configured to be on a side of the barrel.

7. The rifle according to claim 1, wherein the barrel is machined from a single piece of material, and wherein the raceway is machined out of the single piece of material.

* * * * *